US006065709A

United States Patent [19]

Wagter et al.

[11] Patent Number: 6,065,709

[45] Date of Patent: May 23, 2000

[54] CABLE STORAGE REEL

[75] Inventors: Hendrik Sjirk Wagter, Maurik; Ralph Stuyver, Utrecht, both of Netherlands

[73] Assignee: InnoEssentials International B.V., Capelle, Netherlands

[21] Appl. No.: 09/203,072

[22] Filed: Dec. 1, 1998

Related U.S. Application Data

[63] Continuation-in-part of application No. 08/820,165, Mar. 19, 1997, abandoned, and a continuation of application No. PCT/NL95/00311, Sep. 19, 1995.

[30] Foreign Application Priority Data

Sep. 20, 1994 [NL] Netherlands ..... 9401522

[51] Int. Cl.[7] ..... B65H 75/38

[52] U.S. Cl. ..... 242/388.1; 242/405; 242/405.1; 191/12.2 R

[58] Field of Search ..... 242/388.1, 388.4, 242/395, 395.1, 397, 405.2, 405.3, 405.1, 405; 191/12 R, 12.2 R, 12.4

[56] References Cited

U.S. PATENT DOCUMENTS

| | | | |
|---|---|---|---|
| 415,423 | 11/1889 | Smith . | |
| 2,429,675 | 10/1947 | Eypper | 242/388.1 |
| 2,952,420 | 9/1960 | Von Hoorn | 242/388.1 |
| 2,991,523 | 7/1961 | Del Conte | 242/388.1 |
| 3,078,058 | 2/1963 | Roe | 242/405.3 X |
| 3,809,331 | 5/1974 | Gaul | 242/388.1 |
| 3,874,608 | 4/1975 | Quenot | 242/405 |
| 4,150,798 | 4/1979 | Aragon | 242/388.1 |
| 4,172,567 | 10/1979 | Post | 242/405.3 X |
| 4,322,045 | 3/1982 | Tellier | 242/388.1 |
| 4,443,944 | 4/1984 | Beesley . | |
| 5,201,495 | 4/1993 | Crates et al. | 242/405.2 X |
| 5,779,175 | 7/1998 | Shirahase . | |

*Primary Examiner*—Donald P. Walsh
*Assistant Examiner*—William A. Rivera
*Attorney, Agent, or Firm*—Arthur A. Gardner & Associates, P.C.

[57] ABSTRACT

A device for coiling or uncoiling a wire, cable or the like, comprising two cap members. Each cap member has an axis, a circumferential wall portion terminating in a free circumferential edge at one end and gradually merging into an end wall portion at an opposite end. The circumferential wall portion of each cap member has a slit which extends from the free circumferential edge towards the end wall portion. The two cap members are coaxially and freely rotatably assembled with their circumferential edges substantially facing each other, wherein the axes are aligned in a common axis. In the common axis of the two cap members between said opposite end wall portions thereof, a core element is provided, so as to define an annular coiling space around the core element. The two cap members are adapted to the rotated relative to one another. Firstly the two slits are put in mutual alignment to allow the wire, cable or the like to be inserted. Then the two cap members are further rotated to cause the inserted wire, cable or the like to be pulled through the two slits into the coiling space and thereby wound onto the core element.

5 Claims, 2 Drawing Sheets

CABLE STORAGE REEL

CROSS-REFERENCE TO RELATED APPLICATION

This application is a continuation-in-part-application of U.S. application Ser. No. 08/820 165, filed on Mar. 19, 1997, now abandoned, and a continuation of PCT/NL95/00311, filed Sep. 19, 1995.

BACKGROUND OF THE INVENTION

1. Field of the invention

The invention relates to a cable storage reel for coiling or uncoiling a wire, cable or other threadlike materials.

2. Description of the Prior Art

U.S. Pat. No. 4,390,142 discloses a cable storage reel. This known reel comprises two cap-shaped housing parts with a central coiling element therein. The housing parts interconnect while forming a coiling space around the central coiling element. The central coiling element comprises a rotatable disc. The rotatable disc itself has a slot for gripping a part of a wire. The assembly of the two housing parts is at its perimetrical side provided with a slit through which a wire loop can be inserted into the housing, which wire loop then needs to be put into the slot in the rotatable disc. By subsequently rotating the disc relative to the housing, for the purpose of which the disc is operable from outside the housing, the wire is pulled further into the housing and coiled around the central coiling element. It is noted that the two housing parts according to U.S. Pat. No. 4,390,142 can be rotated relative to each other. This relative rotation, however, is limited to a maximum of 180°, because each housing part has cooperating means for limiting the relative rotation therebetween. The purpose of this limited relative rotation is that the ends of a coiled wire part can be brought in line with each other, so that it appears that the wire goes in on one side of the device and comes out diametrically on the other side of the device.

Another device for coiling a wire is known from U.S. Pat. No. 3,084,886. This device also comprises two cap-shaped housing parts defining a coiling space around a central coiling element, in which space a rotatable disc is placed similarly to the mentioned U.S. Pat. No. 4,390,142. The disc comprising the slot in this device, however, is spring tensioned by means of a rubber band extending inside the central coiling element. By releasing the disc so that it can rotate freely under the influence of the tensioned rubber band a wire can be coiled around the central coiling element. The two housing parts according to U.S. Pat. No. 3,084,886 can not be rotated relative to each other.

A disadvantage of these known devices is that they comprise many complex components. Furthermore, the many components of the devices are difficult to assemble and disassemble, and relatively expensive to make. Also the wire loop has to pass through both the slit in the housing and the slot in the disc, which slit and slot therefore need to be aligned with each other before the wire loop can be inserted. Therefore, a coiling operation with the known devices is a complex and time-consuming operation.

U.S. Pat. No. 4,150,798 relates to a cord and line storage reel mainly comprising two shell-like housing parts, rotatably connected to one another. The first housing part comprises a hollow hub member adapted to mate with a solid hub member of the second housing part. The first housing part has one slot aperture disposed across the full diameter of the first housing part. The second housing part comprises two slot apertures at both sides of the solid core hub member. For the purpose of coiling a part of a wire the slot apertures in the two housing parts are to be brought into alignment with one another, after which a part of a wire can be laid down into the slot apertures and hung like a loop over the solid hub member. When subsequently the two housing parts are rotated in opposite directions the wire part is pulled into the housing and wound around the hub members. It is noted that according to U.S. Pat. No. 4,150,798 the axial dimension of the coiling space is only as thick as the diameter of the cord or line to be coiled.

A disadvantage with this known cord and line storage reel is that particularly the first housing part becomes very fragile because of the slot aperture disposed across its full diameter and in particular crossing the central hollow hub member.

A further disadvantage of all the above-mentioned known devices is that, as the wire is initially wound upon the reel, the wire in at least one place goes through a very tight deflection and can kink.

SUMMARY OF THE INVENTION

According to the invention there is provided a device for coiling or uncoiling a wire, cable or the like, comprising:

- two cap members each having an axis, a circumferential wall portion terminating in a free circumferential edge at one end and gradually merging into an end wall portion at an opposite end;
- a slit provided in the circumferential wall portion of each cap member, which slit extends from the free circumferential edge towards the end wall portion of the respective cap member;
- the two cap members being coaxially and freely rotatably assembled with their circumferential edges substantially facing each other, wherein the axes are aligned in a common axis;
- a core element being provided in the common axis of the two cap members between the opposite end wall portions thereof, so as to define an annular coiling space around the core element;
- the two slits being adapted to be brought into mutual alignment at a circumferential location;
- the two cap members being adapted to be rotated relative to one another, to firstly put the two slits in mutual alignment to allow the wire, cable or the like to be inserted therethrough at a sharp angle to the common axis of the cap members, and then to be further rotated to cause the inserted wire, cable or the like to be pulled through the two slits into the coiling space and thereby wound onto the core element.

The object of the present invention is to provide a device for coiling or uncoiling a wire, cable or the like in which the disadvantages of the known cable storage reels of the prior art are eliminated.

This object is achieved according to the invention by the two cap members being freely rotatably connected to each other such that merely by rotating the two cap members relative to each other, the wire, cable or the like is pulled further into the coiling space and coiled around the core element. The cap members of the device according to the invention can be rotated over many 360° turns relative to each other. The invention therefore is based on the insight that a device for coiling or uncoiling a wire, cable or the like does not need a separate rotatable disc that needs to be incorporated inside a housing and that needs to be operable from outside the housing. This makes the device according to the invention much more simple and cheap to make.

For a proper functioning of the device according to the invention, the axial dimension of the coiling space is at least twice the diameter of the wire, cable or the like to be coiled. This is necessary because after each 360° turn of the two cap members relative to each other, two parts of the wire, cable or the like must pass each other.

In contrast to U.S. Pat. No. 4,150,798, the present invention is directed to a cable storage reel which does not have a groove or slot crossing a central core element. Rather the two cap members each include a slit which is being spaced radially from the core element. The cable storage reel according to the invention is thus also based on the insight that it is not necessary to provide the core element with a slot aperture extending therethrough. It suffices to just provide a slit in the circumferential wall portion of each cap member. A wire, cable or the like extending through both slits into the coiling space remains outside the core element during the entire coiling operation.

The sharpest deflection a wire, cable or the like coiled around the core element according to the invention has to make is equal to the curvature of the central part. This deflection is much less sharp than the deflection according to, for example, U.S. Pat. No. 4,150,798 or U.S. Pat. No. 4,390,142. The wire, cable or the like thus does not kink during a coiling operation, which contributes to the wire, cable or the like not being damaged during coiling.

BRIEF DESCRIPTION OF THE DRAWINGS

The invention will be explained in more detail with reference to the enclosed drawings, in which.

DETAILED DESCRIPTION OF THE PREFERRED EMBODIMENTS

Figures 1A, 1B, 1C:
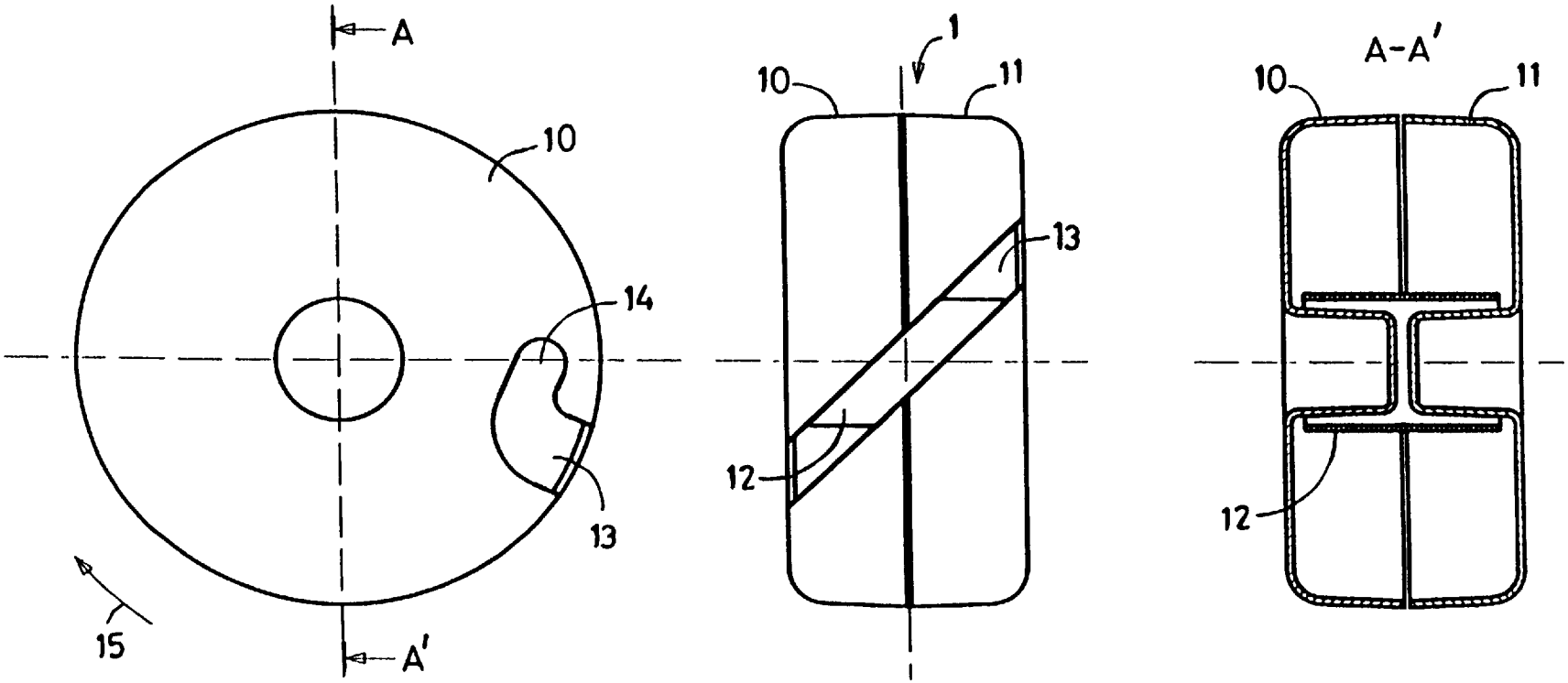
FIGS. 1*a, b* and *c* respectively show a front view, a side view and a cross-section along the line A-A' of a first embodiment of the device according to the invention.

In FIG. 1 the device consists of a housing 1 that has the shape of a closed flat box. Housing 1 consists of two cap members 10, 11 which can rotate in relation to one another, that connect to each other while forming a coiling space around a core element 12. The circumferential wall portions of the cap members contain slits 13 for taking and positioning the wire, cable or other thread-like material. By turning the first cap member 10 and the second cap member 11 in relation to one another a wire can be coiled around the core element 12. Before inserting a wire into the slits, the slits 13 need to be positioned in relation to one another in such a way that they form a single continuous slit into which the wire can be inserted. To be able to better retain the wire in the separate slits 13, these can be extended for at least the thickness of the wire to be coiled in the end wall portions of housing 1 and contain, if desired, a portion 14 that forms an angle (for example of 90°) with the starting direction of the slits 13, of which the slit portions in the end wall portions of the two respective cap members are in opposite directions. The core element 12 can be rigidly fixed to one of the two cap members 10, 11 or turn freely in relation to both cap members 10, 11. Arrow 15 shows the turning direction of the cap member 10 for coiling the wire.

Figure 2B:
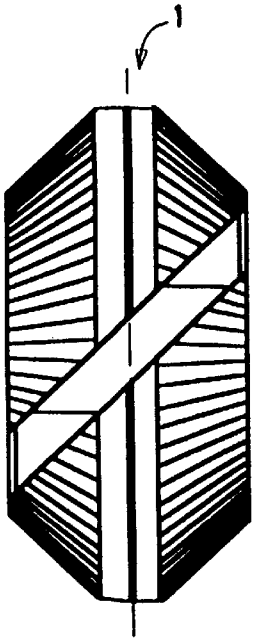
FIGS. 2*a* and *b* respectively show a front view and a side view of a second embodiment in which a profile has been applied to the housing parts.
Figure 2A:
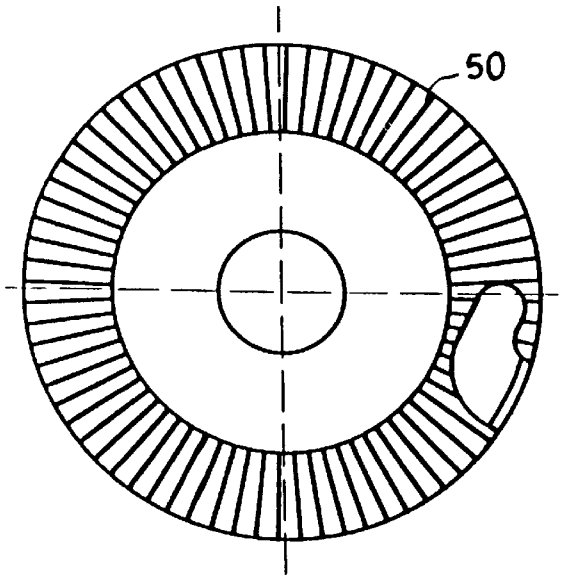

In FIG. 2 housing 1 is supplied on the outside with a profile 50 for a better grip and stronger construction.

Figure 3:
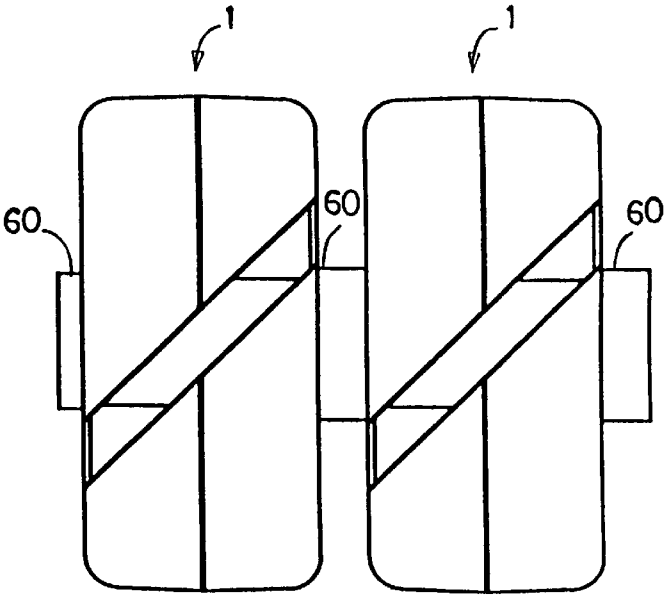
FIG. 3 shows two coupled devices according to the invention.

In FIG. 3 on the two end wall portions of the housing there are aids 60 for coupling more devices to one another.

The two cap members 10, 11 being coaxially and freely rotatably assembled with their circumferential edges substantially facing each other together form the housing 1 which may be of any shape, for example spherical or having the shape of a closed flat box.

During coiling, a wire, cable or the like can be held better in the separate slits 13 if each slit has two portions, a first portion extending substantially axially from the circumferential edge of the cap member 10, 11 towards a second portion 14 which extends substantially in a direction parallel to the circumferential edge of the cap members 10, 11, the second portions 14 of the slits 13 of the two respective cap members 10, 11 being directed in opposite directions to one another.

The core element in the device can be an integrated component of the two cap members, so that the device in its simplest form contains only two parts. The connection of the two parts can be made by a snap fit joint that permits rotation, makes a simple mounting possible and which can disconnect when too much tension is applied to it, for example when somebody's foot gets stuck behind the wire, cable or the like. Additionally the snap fit joint can also be disconnected by a component such as a knob, which can be operated from the outside of the housing. Other joints, like a pin with security rings, remain possible. The circumferential edges of the cap members, facing each other, can be made in such a way that they ratchet into each other, to prevent an inconvenient shifting of the cap members, for example by a groove in one edge and a cam fitting into it on the other edge.

It is possible to make the core element hollow so that it may be put on a rod or something similar.

In a particular advantageous embodiment the core element is formed by a tube-like element 12 which is mounted for free rotation between the opposite end wall portions of the cap members 10, 11. The freely rotatable tube-like element 12 serves the purpose of the whole device being easily slidably movable over the wire, cable or the like even after a big portion of wire, cable or the like has already been coiled. Hence it is no longer necessary to place the device exactly in the middle of the wire, cable or is the like to be coiled. During a sliding movement of the device over the wire, cable or the like the number of windings around the tube-like element 12 remains the same. What happens is that at one end the wire, cable or the like uncoils while at the other end the same amount of wire, cable or the like is being coiled. This is possible because, in contrast to the known cable storage reels, the windings of a coiled wire, cable or the like around the tube-like element 12 according to the invention are all directed in the same rotational direction.

While the invention has been described in preferred forms, those skilled in the art will recognize that many modifications, additions, and deletions can be made therein without departing from the spirit and scope of the invention as defined in the following claims.

What is claimed is:

1. A device for coiling or uncoiling a wire or cable comprising:

two cap members each having an axis, a circumferential wall portion terminating in a free circumferential edge at one end and gradually merging into an end wall portion at an opposite end;

a slit provided in said circumferential wall portion of each cap member, which slit extends from said free circumferential edge towards said end wall portion of the respective cap member, each slit further comprises two portions, including a first portion extending substantially axially from said circumferential edge of said cap member towards a second portion which extends substantially in a direction parallel to said circumferential edge of said cap members, said second portions of said slits of said two respective cap members pointing in opposite directions;

said two cap members being coaxially and freely rotatably assembled with their circumferential edges substantially facing each other, wherein said axes are aligned in a common axis;

a core element being provided in said common axis of said two cap members between said opposite end wall portions thereof, so as to define an annular coiling space around said core element;

said two slits being adapted to be brought into mutual alignment at a circumferential location;

said two cap members being adapted to be rotated relative to one another, to firstly put said two slits in mutual alignment to allow the wire or cable to be inserted therethrough at an angle to said common axis of said cap members, and then to be further rotated to cause the inserted wire or cable to be pulled through said two slits into said coiling space and thereby wound onto said core element.

2. A device according to claim 1, in which said core element is formed by a tube-like element which is mounted for free rotation between said opposite end wall portions of said cap members.

3. A device according to claim 2, in which said tube-like element is journalled with its ends on substantially circular protuberances extending inwardly from said opposite end wall portions.

4. A device as claimed in claim 1 wherein the axial dimension of the coiling space is at least twice the diameter of the wire or cable to be coiled.

5. A method for coiling a wire or cable using a cable storage reel, with the cable storage reel including two cap members each having an axis of rotation, a circumferential wall portion, and an end wall portion, with the circumferential wall portion of each cap member including a slit which extends thereacross and in the general direction of the axis of rotation, the axis of rotation of each of the cap members being aligned with each other, the cable storage reel further including a core element aligned with the common axes of rotation and the cable storage reel defining a coiling space around the core element, said method comprising the steps of:

aligning the slit in one of the cap members with the slit in the other cap member;

placing a wire or cable in the slits so that it extends through the cap members beyond the end wall portions thereof of the cable storage reel; and rotating the cap members relative to each other to cause the inserted wire or cable to be pulled further through the slits and into the coiling space and thereby wound around and onto the core element.

* * * * *